United States Patent [19]

Ty et al.

[11] Patent Number: 4,920,624

[45] Date of Patent: May 1, 1990

[54] METHOD AND APPARATUS FOR MAKING A DOUBLE HELIX THERMOSTAT METAL SPRING

[75] Inventors: Henry Ty, Attleboro, Mass.; John Baptista, Pawtucket, R.I.; George DeAmaral, Rehoboth, Mass.

[73] Assignee: Texas Instruments Incorporated, Dallas, Tex.

[21] Appl. No.: 281,298

[22] Filed: Dec. 7, 1988

[51] Int. Cl.[5] ..... B21F 35/00

[52] U.S. Cl. ..... 29/173; 72/142

[58] Field of Search ..... 140/71.5; 72/142, 371, 72/135; 29/173

[56] References Cited

U.S. PATENT DOCUMENTS

| | | | |
|---|---|---|---|
| 2,136,649 | 11/1938 | Wadsten | 140/71.5 |
| 2,142,865 | 1/1939 | Zabel | 72/135 |
| 2,537,435 | 1/1951 | Warmey | 72/135 |
| 3,048,201 | 8/1962 | Johnson | 140/71.5 |
| 4,408,639 | 10/1983 | Hayama et al. | 140/71.5 |

*Primary Examiner*—P. W. Echols

*Attorney, Agent, or Firm*—James P. McAndrews; John A. Haug; Melvin Sharp

[57] ABSTRACT

The disclosure relates to a method and apparatus for fabricating a double helix coil comprising the steps of and apparatus for coiling a wire into a first helix, removably securing one end portion of the first helix to an arbor, coiling the first helix about the arbor to form a coil having a second helix, detaching the one end portion of the coil from the arbor and removing the double helix coil from the arbor.

12 Claims, 3 Drawing Sheets

METHOD AND APPARATUS FOR MAKING A DOUBLE HELIX THERMOSTAT METAL SPRING

BACKGROUND OF THE INVENTION

1. Field of the Invention

This invention relates to double helix coils or springs, preferably formed from thermostatic metal and, more specifically, to a method and apparatus for fabrication of such coils or springs.

2. Brief Description of the Prior Art

Double helix coils or springs, preferably of the type formed from thermostat metal, are known in the art. A double helix coil or spring is essentially a helical member wherein the helix is formed from a prior formed helically shaped member. In other words, a double helix is formed by forming a wire shaped member, which can be flat or circular, into a first helix about the wire axis and then forming the first helix into a second helix about the axis of the first helix. Such coils or springs effect a linear motion and a linear force in accordance with ambient temperature change.

The conventional method of manufacturing a double helix coil or spring is to torsionally wind a first helix with an extended tab on each end of the first helix for use in subsequent operations. A secondary operation, also by torsional means, uses one of the tabs for anchoring the first helix to an arbor while the tab on the opposite end of the first helix is gripped so that tension can be applied to produce the desired torsion while a second helix is being wound. A third operation usually follows to stretch the now formed double helix to the desired free length. The two tabs at opposing ends of the double helix member identified hereinabove are usually used for attaching other helix fabrication means thereto. The tabs are then removed to provide the completed double helix spring.

A problem inherent in the prior art method and apparatus for forming such double helix coils or springs is that the apparatus for forming the spring or coil requires hand feeding for each operation and an excessive number of operations, such as, for example, the formation and later removal of the tabs at opposing ends of the spring or coil to enable operation thereon to form the double helix coil. For example, the application of a "thermal spring" will usually be to replace a mono-metal spring when thermal force compensation is necessary, in which case, the two tabs of a conventional double helix spring or coil must be eliminated. To do so, a fourth and perhaps fifth operation may be necessary to cut off the two tabs in the conventional method of manufacturing.

SUMMARY OF THE INVENTION

In accordance with the present invention, the above noted drawbacks of the prior art are minimized and there is provided a method and apparatus for forming double helix coils or springs which requires a substantially reduced amount of manual labor compared with prior art methods of forming such coils or springs as well as a reduced number of processing operations. For example, the need for the tabs on opposing ends of the coil or spring is removed, thereby eliminating the need to form the tabs as well as the need for removal thereof.

A novel application of the double helix coil or spring in accordance with the present invention is referred to herein as a "thermal spring". The "thermal spring" is analogous to a conventional compression spring of mono-metal in that it can be designed to produce the same mechanical force as the compression spring when in the installed length at room temperature. In the "thermal spring", however, this force can be designed to vary with temperature changes at different thermal force rates.

Briefly, in accordance with the present method and apparatus, a metal, preferably a thermostat metal, ribbon-like strip of small preferably rectangular cross-section is fed between two drive rollers so that the advancing or lead end of the strip is forced against a deflection tool or cam of a deflection coil winding machine or primary coiling device of standard design, such as, for example, a Torrington coiling machine, and is deflected to wind the thermostat metal strip into a continuous first helix of standard type and indefinite length to produce the "primary" turns or primary coil for one or more double helix coils or springs to be formed in subsequent processing steps. The rate of material advance and the angle of the deflection cam determine the pitch of the primary coil to be formed in known manner. As the primary coil of indefinite length is formed, it moves at an oblique angle relative to the general plane of the primary coil machine, exits that machine and moves into the auxiliary, novel and specialized equipment for completion of formation of the double helix "thermal spring" manufacturing process.

The specialized apparatus includes mechanisms (a) to feed a prescribed length of the primary wound helix coil of indefinite length when it has received a signal from the primary coil winder that a predetermined length of primary helix has been formed therein, (b) to clamp the free end of the primary coil and, if necessary, to form that end of the primary coil in a proper helix against an arbor, (c) to cause a prescribed length of the primary helix coil to be cut off from the primary coil entering the cutter while continuing to clamp the free end of the coil to provide a clamped helical coil of prescribed length and of shaped or formed clamped end, (d) to torsionally wind the clamped helical coil of prescribed length about the arbor to a predetermined pitch to obtain the desired secondary helical coil of desired length, (e) to release the clamp, (f) to remove the now formed double helix coil or spring from the arbor and (g) to eject the finished double helix spring from the coiling apparatus. The primary wound helix coil of indefinite length is then again fed to the specialized apparatus, again in the manner discussed hereinabove, to repeat the operating cycle for production of another double helix spring or coil. Each machine cycle produces one complete finished double helix coil or "thermal spring" in a progressive sequence as described above.

The specialized secondary coiling apparatus discussed hereinabove includes a cutter through which the primary helical coil is fed, the coil continuing to a clamping device and an iron out tool disposed adjacent a rotary member in the form of an arbor. The clamping device clamps the free end portion of the primary helical coil of indefinite length against the arbor and then signals the cutter whereupon a portion of the primary wound helical coil provided by the primary coiling device is cut to a predetermined length. The iron out tool is moved against the end of the coil in the event a portion thereof protrudes to insure that the clamped end portion thereof is also wound or formed about the arbor to provide a proper helix shaped in the end portion in the event of improper (excessive) initial feed of the primary coil. The clamping device, which still clamps the coil against the arbor, is then released from its original position in the apparatus for rotation about the arbor and is rotated with the cutter and iron out tool which are moving together along the arbor and away from the clamping device at a predetermined speed to provide the desired pitch between coils of the second helix being formed. The iron out tool causes the primary helix to form as a second helix about the arbor by abutting the primary helix during travel and rotation thereof. During this portion of the procedure, a transporter is positioned with a pair of fingers integral therewith enclosing the arbor therebetween, the fingers being positioned behind the initial feed point of the primary helix relative to the direction of cutter travel during coil winding. The transporter is in this position initially at the very beginning of the coiling sequence.

After the entire cut portion of the primary helix has been wound about the arbor to form the second helical coil, the clamping device rotates in the opposite direction because the clamping device cannot be opened to release the finished coil in any other position except the original position and the cutter and iron out tool return to their initial position. The clamping device then opens to permit the now formed double helix coil to freely rest on the arbor. The transporter now moves in the direction of coiling of the second helix along the arbor, the fingers thereon abutting the double helix coil and withdrawing the coil from the arbor and onto the floor of the transporter. The transporter continues its travel until a force on the coil, preferably in the form of an air current, is provided and forces the coil into a chute to a storage area. The transporter then returns to its initial position and the system is now in position for feeding thereto of a further length of the primary helix for formation of another coil.

It can be seen that there has been provided a system and method capable of forming a double helix coil or spring from an initial length of wire without manual operation.

DESCRIPTION OF THE PREFERRED EMBODIMENT

Figure 1:
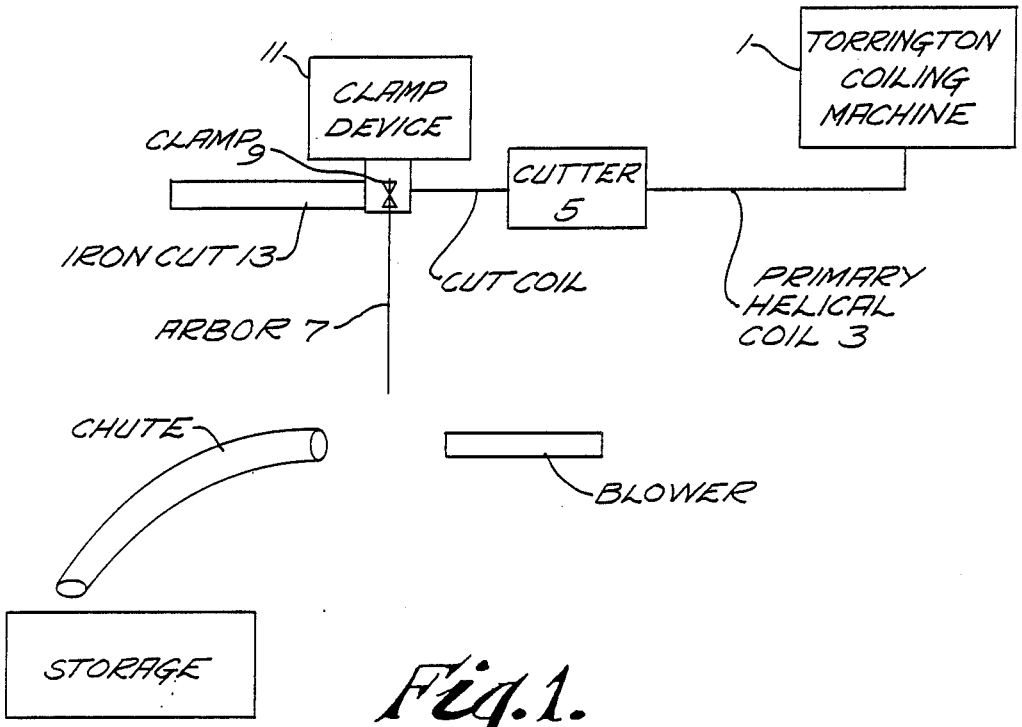
FIGS. 1 to 6 are schematic drawings of the system in accordance with the present invention for providing double helix coils or springs.

Referring now to the drawings, there is shown a schematic drawing of the system for fabrication of double helix coils in accordance with a preferred embodiment of the present invention.

FIG. 1 sets forth schematically all of the required structure with the exception of the transporter (discussed hereinbelow) and the timing mechanism. The timing is provided using cams and air cylinders operated in response to cam position although electronic timing could also be used. Such timing systems are well within the skill of the art and are not described in detail herein.

The timing mechanism is composed of a steel plate mounted on a key-way and attached to the rod of an air cylinder. There are five cams mounted on this steel plate at different locations. Above the cams are five 4-way valves with one way cam followers at the end of the shaft, mounted in line with the cams. Each valve operates one or more air cylinders. Once the air cylinder attached to the steel plate receives a signal from the Torrington coiler, the coiling sequence begins. The plate with the cams starts to move forward at a controlled speed and thus the valves are activated by the cams at the proper time. Timing changes are achieved by advancing or retarding the cams.

The system includes a device 1 for forming the primary helical coil 3 from a strip of rectangular or circular wire, preferably of thermostatic metal. Devices of this type are well known in the art, a Torrington coiling machine being a preferred coiling machine. When a predetermined length of primary coil has been formed by the coiling machine 1, a signal is provided to a timing mechanism of standard design and causes the remainder of the system, to be discussed hereinbelow which forms the second helix of the double helix spring or coil, to commence operation.

The primary coil 3 is fed to and through a coil feeder and cutter 5 with the free end of the coil extending over an arbor 7 whereat the free end of the coil is clamped against the arbor by a clamp 9 of a clamp device 11. An iron out device 13 then moves against any portion of the coil 3 which may extend beyond the clamp 9 to form the end of the coil in a proper helix around the arbor and remains in that position. The cutter now receives a signal to perform its cutting action and cuts the primary coil 3 to provide a predetermined length of coil clamped between the clamp 9 and arbor 7.

Figure 2:
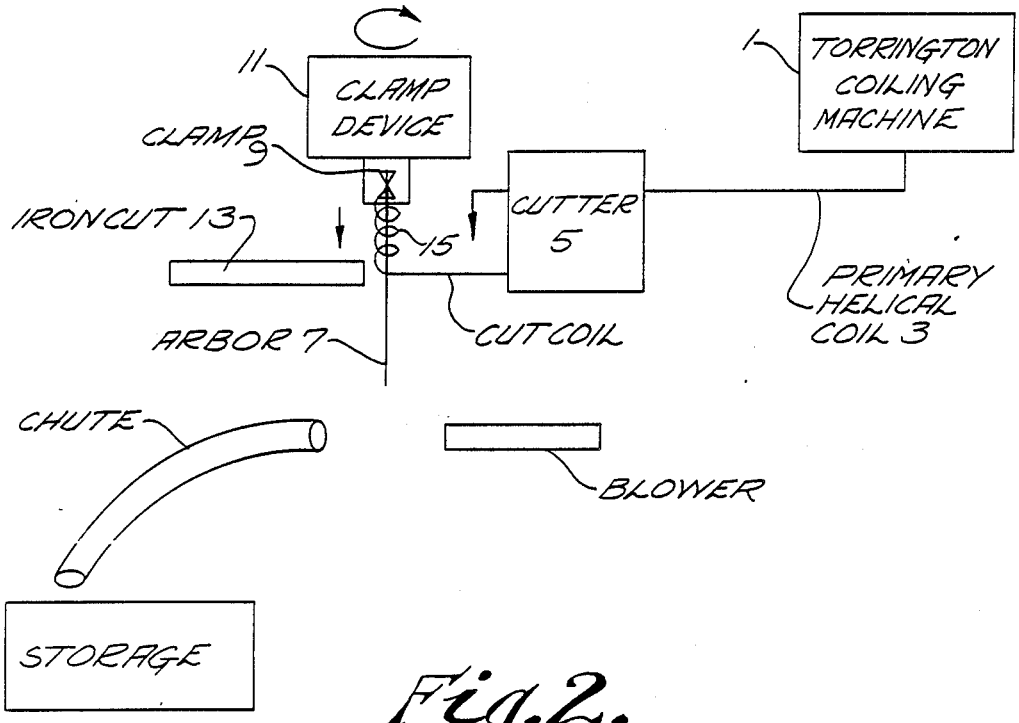

With reference to FIG. 2, the clamp device 11 with clamp 9 attached thereto now proceeds from its position in the apparatus shown in FIG. 1 to rotate about the axis of the arbor 7 with the cutter 5 and iron out device 13, at the same time, moving together along the arbor in a direction away from the clamp 9 and in the direction of the arrows, whereby the iron out device causes the primary coil 3 to curl around the arbor to commence formation of the double helix coil or spring 15. The speed of the cutter and iron out device along the arbor in the direction of the arrows with respect to the speed of rotation of the clamp 9 and clamp device 11 are predetermined since they determine the pitch of the helix being formed.

Figure 3:
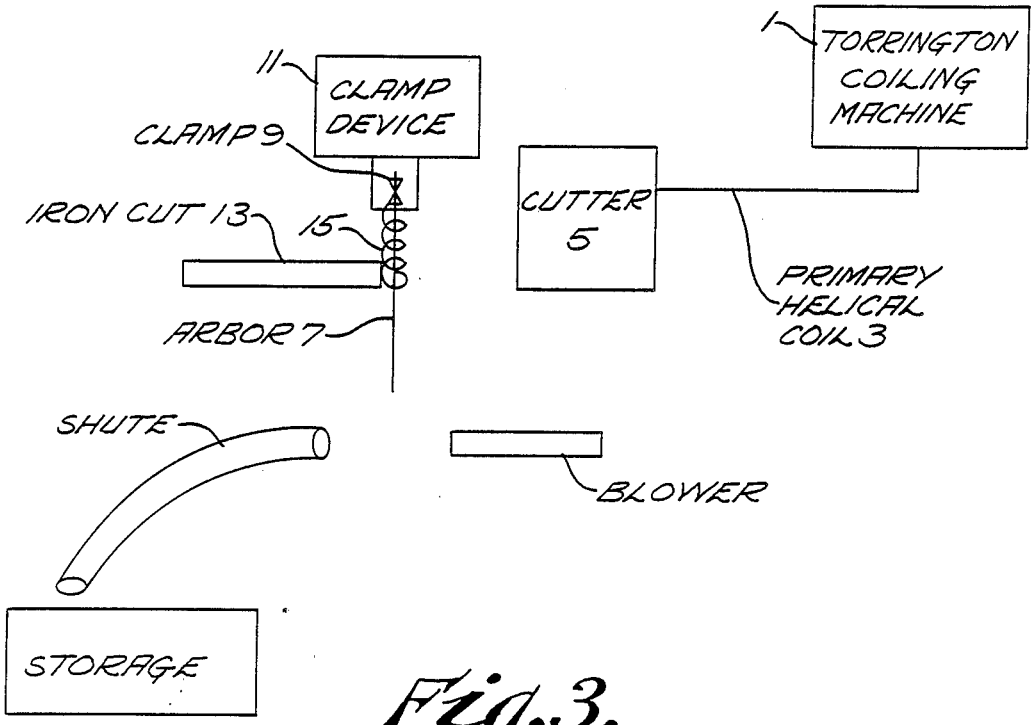

With reference to FIG. 3, the cutter 5 and iron out device 13 continue to move together in the direction of the arrows in FIG. 2 until the entire predetermined length of the cut primary coil 3 has been fed out of the cutter and coiled about the arbor 7 to form the completed double helix coil or spring 15. It can be seen that at the stage of the fabrication procedure in FIG. 3 the cutter 5 and iron out device 13 have advanced in the direction of the arrow in FIG. 2 to their extreme position with the completed coil 15 resting on the arbor 7 and clamped thereto by the clamp 9.

Figure 4:
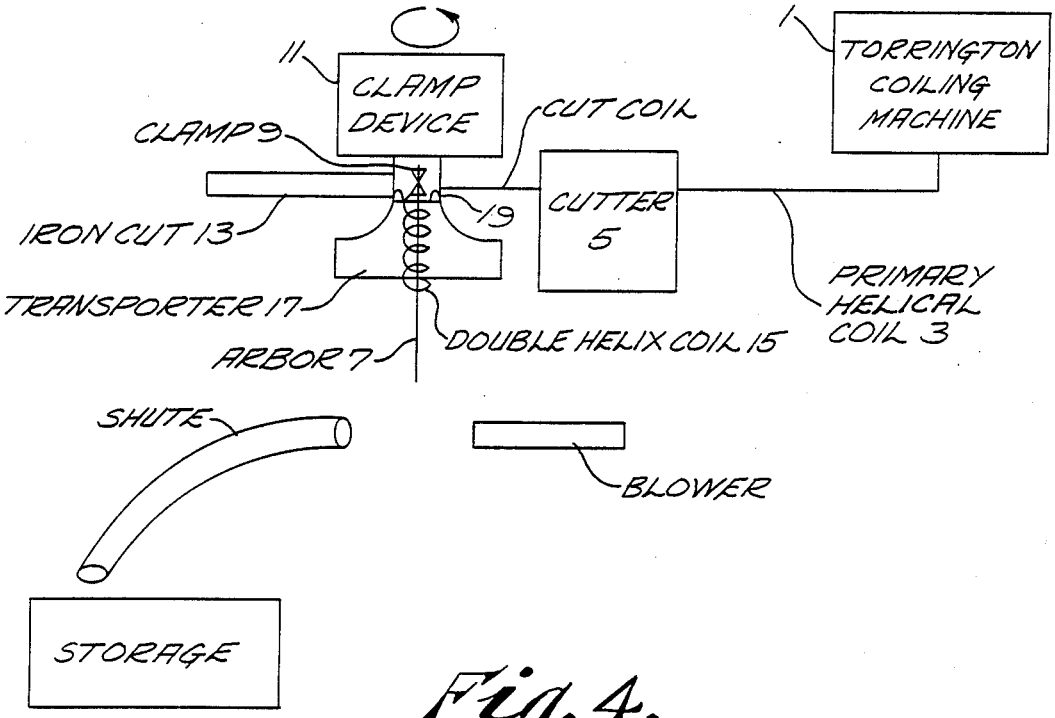
Figure 5:
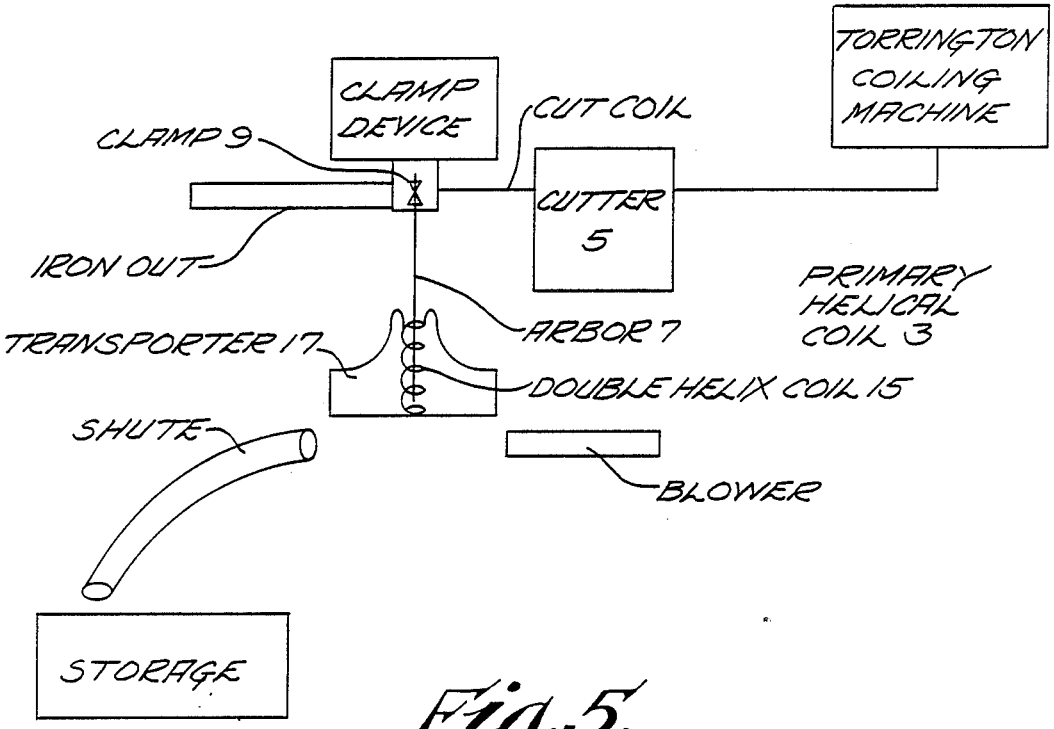
Figure 6:
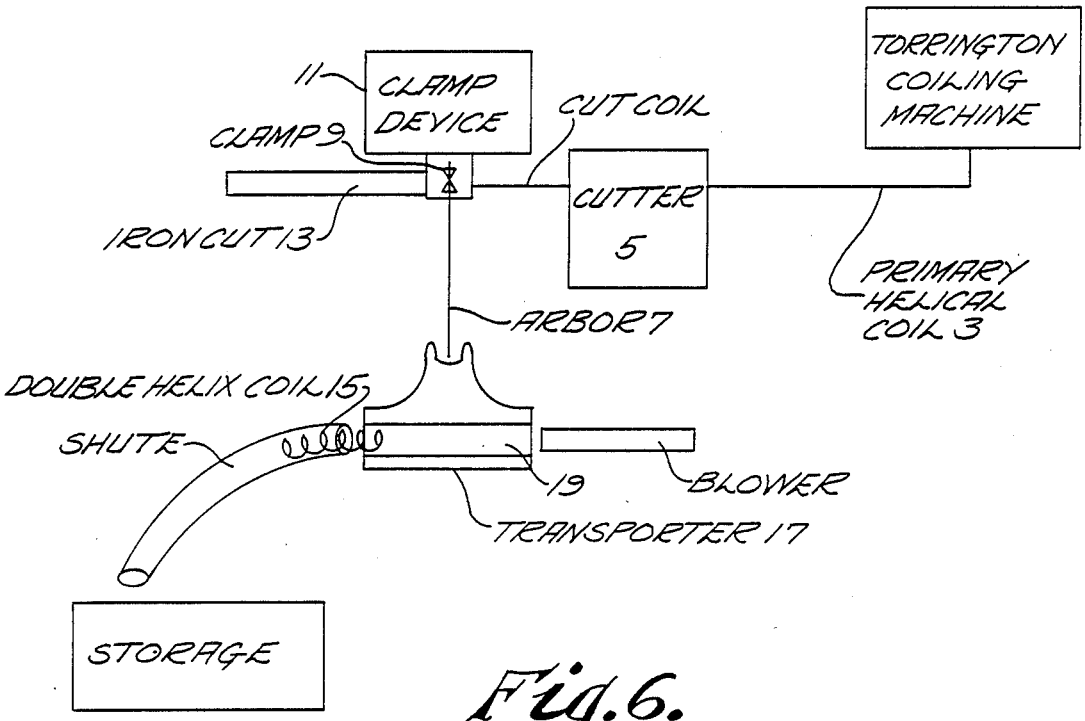

Referring now to FIG. 4, the cutter 5 and iron out device 13 return to their initial positions as shown in FIG. 1 with the iron out device also retracted away from the arbor 7. In addition, the clamp 9 has opened to permit the coil 15 to rest freely on the arbor. In addition, a transporter 17 having a pair of upwardly extending fingers 19 which are positioned on opposite sides of the arbor and behind the coil 15 and which has constantly been in the position shown in FIG. 4 but with the fingers positioned down and below the arbor and the rotating parts until the end of the reverse rotation of the arbor, now moves upwardly with the fingers on opposite sides of the arbor. Then the transporter and finger portions thereof move in the direction along the arbor and away from the clamp 9. The fingers abut the edge of the coil 15 at the clamp 9 as the transporter movement continues and moves the coil along the arbor 7 thereby as shown in FIG. 5. With further movement of the transporter 17 as shown in FIG. 6, the coil 15 falls from the arbor 7 and into a groove 19 in the transporter extending laterally across the transporter. The transporter finally arrives at a position wherein the groove 19 is positioned between a blower 21 and a chute 23. The blower 21 provides air of sufficient velocity when aligned with the groove 19 to move the coil 15 along the groove and into the chute 23. The coil 15 then proceeds to travel down the chute 23 and into a storage bin 25. The transporter now returns to its initial position as shown in FIG. 4 and the system is now reset to fabricate another double helix coil.

It can be seen that there has been provided a process and system for fabrication of double helix coils which is completely automatic and of far greater efficiency than systems of the prior art for producing similar devices.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. The method of fabricating a double helix coil comprising the steps of:

(a) providing a strip of wire;

(b) coiling said wire into a first helix;

(c) removably securing one end portion of said first helix to an arbor and forming said end portion of said first helix about said arbor to provide a proper helix shape in said one end portion of the first helix on the arbor;

(d) coiling said first helix about said arbor to form a coil having a second helix including said one end portion therein;

(e) detaching said one end portion from said arbor; and (f) removing said coil having said second helic from said arbor.

2. The method of claim 1 further including the step of cutting said strip of wire to a predetermined length after step (c).

3. The method of claim 2 further including the step of transferring said coil of step (f) to a storage area.

4. The method of claim 2 further including the step of transferring said coil of step (f) to a storage area.

5. A system for fabricating a double helix coil comprising:

(a) first coiling means for coiling a wire into a first helix;

(b) an arbor;

(c) means to removably secure one end portion of said first helix to said arbor and to form a proper helix shape in said one end portion of the first helix on the arbor;

(d) second means for coiling said first helix about said arbor to form a coil having a second helix including said one end portion therein; and (e) a means for removing said coil having a second helix from said arbor.

6. A system as set forth in claim 5 wherein said means to removably secure is a clamp and said second means for coiling includes said clamp and further includes means to rotate said arbor relative to said first helix.

7. A system as set forth in claim 6 wherein said means for removing includes means for moving said second helix along said arbor in a direction away from said means to removably secure one end portion of said first helix.

8. A system as set forth in claim 7 wherein said means for removing further includes a finger movable coaxially with said arbor for abutting said second helix and storage means disposable at the end of said arbor for receiving said coil removed from said arbor.

9. A system as set forth in claim 6 wherein said means for removing further includes a finger movable coaxially with said arbor for abutting said second helix and storage means disposable at the end of said arbor for receiving said coil removed from said arbor.

10. A system as set forth in claim 5 wherein said means for removing includes means for moving said second helix along said arbor in a direction away from said means to removably secure one end portion of said first helix.

11. A system as set forth in claim 10 wherein said means for removing further includes a finger movable coaxially with said arbor for abutting said second helix and storage means disposable at the end of said arbor for receiving said coil removed from said arbor.

12. A system as set forth in claim 5 wherein said means for removing further includes a finger movable coaxially with said arbor for abutting said second helix and storage means disposable at the end of said arbor for receiving said coil removed from said arbor.

* * * * *